United States Patent [19]

Larsen

[11] 4,449,844

[45] May 22, 1984

[54] DOWEL FOR PAVEMENT JOINTS

[76] Inventor: Torbjorn J. Larsen, 3719 NW. 29th St., Gainsville, Fla. 32605

[21] Appl. No.: 422,672

[22] Filed: Sep. 24, 1982

[51] Int. Cl.[3] ..... E01C 11/14; E01C 11/02

[52] U.S. Cl. ..... 404/60; 404/59

[58] Field of Search ..... 404/56, 61, 59, 62, 404/63, 60, 70; 52/573, 586, 396

[56] References Cited

U.S. PATENT DOCUMENTS

| | | | |
|---|---|---|---|
| 905,480 | 12/1908 | Thomas | 52/737 |
| 1,637,215 | 7/1927 | Coppuck | 404/70 |
| 1,637,742 | 8/1927 | Edge | 404/70 |
| 1,755,219 | 4/1930 | Knox | 404/60 |
| 1,826,062 | 10/1931 | Farmer | 404/61 |
| 2,176,574 | 10/1939 | Jacobson | 404/61 |
| 2,536,611 | 1/1951 | Miller | 404/51 |
| 2,651,243 | 9/1953 | Guille | 404/61 |
| 3,437,017 | 4/1969 | Walz | 404/60 |
| 3,785,741 | 1/1974 | Lodige | 404/51 |
| 3,972,640 | 8/1976 | Miller | 404/60 |

OTHER PUBLICATIONS

"Principles of Pavement Design," E. J. Yoder, M. W. Witczak, 2nd Ed., pp. 94–99, 102–103, 609–612.

"Recommended Practice for Design of Concrete Pavements," (ACI 325-358), ACI Committee 325, Feb. 25, 1958, pp. 11–19.

*Primary Examiner*—Ernest R. Purser

*Assistant Examiner*—Mark J. DelSignore

*Attorney, Agent, or Firm*—Macdonald J. Wiggins

[57] ABSTRACT

A device for transferring vertical shear stress and bending moments across transverse joints in concrete pavement slabs and the like, and for simultaneously controlling the joint gap width. A dowel is formed from a continuous length of steel bar, treated to cause its outer ends to bond to concrete and its central portion treated to prevent bonding to concrete. The outer ends of each bar is formed to permit the center portion to be disposed near either the top surface or bottom surface of the slab sections and the outer ends along the neutral axis of the slab sections. The bars are used in pairs with one center portion adjacent the top surface and the other one adjacent the bottom surface. A multiplicity of such dowels is embedded in the concrete of a continuously-poured concrete slab aligned with the roadway and in a spaced relationship across the slab. The concrete is grooved before curing across the slab and over the central portions of the dowels. As the concrete cures, the outer ends of the dowels bond to the concrete while the central portions remain unbonded causing a joint crack and strain produced in the concrete due to shrinkage which is partially transferred to the unbonded steel which acts as a latent spring to subsequently control the gap width. The dowels additionally serve to transfer bending moments and vertical shear stresses from live loads across the pavement joint.

2 Claims, 19 Drawing Figures

DOWEL FOR PAVEMENT JOINTS

This application is a continuation-in-part of copending application, Ser. No. 262,048 filed May 11, 1981.

BACKGROUND OF THE INVENTION

1. Field of the Invention

The invention relates generally to devices for transferring loads between slab sections of concrete highway pavements and the like, and more specifically to a pavement joint dowel having elastic characteristics.

2. Description of the Prior Art

In construction of concrete pavements for highways, airport runways, and the like, it is necessary to divide the structure into convenient slab section lengths to prevent random cracking of the concrete. To this end, a monolithic concrete slab is first poured and allowed to set for a short period. Next, transverse grooves having a depth on the order of one-fourth the slab thickness are cut across the slab, with spacing between cuts selected in accordance with the application and design. For example, spacings from 12 to 40 feet are common for highway pavements.

As the concrete of the slab cures, the forces from the exothermal reactions cause cracks through the slab thickness to develop at the reduced cross-sections below each groove. This action effectively divides the pavement slab into predetermined separate slab sections. As may be understood, the vertical cracks have adjacent and interlocking faces formed by the cement and aggregates in the concrete. Such interlocking faces serve to transfer the vertical shear stresses from one slab section to the next as vehicles pass over the joint. This functioning is referred to as the result of "aggregate interlock."

Slabs dependent solely on aggregate interlock for shear stress transfer have problems as wear at the interface occurs with use of the highway, and with volume decrease of the slabs caused by extreme temperature changes. As traffic continues to pass over a joint and the interfaces wear and become smooth, the interlock eventually fails, resulting in vertical displacement of the slab sections and a rough, bumpy highway surface. Another result of such failure is that water intrusion at the joint can occur with damage to the slab from freezing.

A prior art improvement in slab joint design is the use of dowels implanted in the concrete and extending longitudinally across the joint interfaces. The dowels are typically formed from smooth steel rods with diameters on the order of one inch and lengths of two feet. Each rod is coated or otherwise treated so that it will not bond to the concrete along its length or at least on one end. Thus, as the slab expands and contracts during curing and subsequently with temperature changes, the dowel is free to move relative to the concrete and no stress is set up in the dowel. The dowel serves to maintain alignment of adjacent slab sections and participates along with the aggregate interlock to transfer the vertical shear stresses across the joint.

A major disadvantage of the prior art dowels and application techniques is that the slab sections are independent. Thus, shrinkage or contraction of slab sections over extended periods of time can cause large gaps to occur at the joints. Water and road salt intrusion then occurs with corrosion of the dowel rods and possible shear failure. Similarly, water intrusion can produce slab cracking from freezing. Another problem with the unbonded dowel stems from the moments produced as heavy loads pass over a joint. The dowel cannot transfer these bending moments and can be bent or deformed when wide joint gaps occur.

SUMMARY OF THE INVENTION

The invention is an improved dowel that overcomes the problem associated with known prior art stress transfer devices. One embodiment of my invention comprises a dowel fabricated from a steel rod having means for preventing bonding to concrete only over the central portion of the rod. Preferably, the rod is a standard steel reinforcing bar having a deformed or textured surface for securing a firm bond to concrete when imbedded therein. The central portion of the bar is treated to prevent that region from bonding to concrete.

Prior to pouring of a concrete roadway or the like, dowels are disposed parallel with the roadway with each dowel centered at the location of the planned joint between slab sections. A multiplicity of dowels disposed transversely across the roadway in a spaced relationship and maintained such that the dowels will be approximately centered vertically in the slab when poured. After pouring of the concrete, a groove is cut transversely across the top surface of the slab above the dowel locations causing the desired crack to form as the concrete cures. As may now be recognized, the crack will occur approximately at the midpoint of each dowel over the unbonded area of the dowel.

As the concrete sets and cures, it securely bonds to the uncoated ends of each dowel but advantageously does not bond to the treated central portions of the dowel. Thus, in use, a dowel will be bonded at one end in one slab section and unbonded for a selected distance to the joint face. The unbonded portion extends into the adjacent slab section for a selected distance and the opposite dowel end is bonded to the concrete in that slab section. The size of the dowel bar, the lengths of the unbonded and bonded portions thereof, and the spacing of the dowels are determined from the desired slab section lengths, the slab thickness, and other pavement design parameters as will be discussed in detail hereinafter.

The installed dowels serve several important functions. First the dowels serve to transfer vertical shear stresses from one slab section to another. Second, the dowels prevent vertical displacement of the sections and prevents damage to the aggregate interlock due to relative vertical movement between adjacent slab sections. Third, the unbonded cemtral portions of the dowels act as latent springs to oppose longitudinal displacement of the slab sections thereby controlling the joint gap or opening to a specifically selected design distance. Additionally, by proper placement of the dowels, a resistance moment opposing the bending moments due to live loads can be produced.

The latent spring function of my dowel provides important advantages over prior art joint construction. As is well known curing of the slab concrete results in shrinkage and a gap at the joint. Similarly, temperature changes can cause the length of a slab section to vary with time and the joint gap can vary in an uncontrolled manner. Inasmuch as each end of my dowel is firmly bonded and anchored in its slab section, any shortening or lengthening of the sections will cause the unbonded region of the dowel to slightly stretch or contract. Due to the initial stretching of the dowel during curing of the concrete, the latent spring action creates a strain in the steel. Thus, the magnitude of the changes in slab lengths with temperature are limited by the resultant spring action of the dowels. As may now be recognized, the dowel parameters can be selected to produce the necessary counter-acting force to match the forces tending to change the slab lengths. By selecting the proper length and sizes of the dowels, the strain in the steel may be maintained within the elastic limits of the steel for all possible operating parameters of the pavement.

As previously mentioned, prior art dowels have been unbonded and cannot therefore control the joint opening. Ultimately, then, the joint can fail from deterioration of the aggregate interlock as the joint "works" and due to infiltration of water and road salt into the joint. By contrast, my dowel by virtue of its spring action restricts the maximum gap to a value calculated during design. The integrity of the aggregate interlock is maintained and infiltration essentially eliminated.

A number of advantages obtain from this feature of my invention, not available from prior art joint construction. First, the maintenance costs over the life of the pavement are greatly reduced. For example, it is generally understood that joint maintenance accounts for about 95% of highway maintenance costs with prior art designs. Second, for a specified design life, the slab thickness may be reduced resulting in a lower initial cost.

My improved dowel can be fabricated at very low cost due to its simplicity, and therefore adds no extra cost over the use of prior art dowels, and in many cases may reduce the initial cost of pavement joints.

It is therefore a primary object of my invention to provide a stress transfer device having elastic properties for use in construction and operation of highway concrete pavement slabs and the like.

It is another object of my invention to provide a device for transferring vertical shear stress across joints in concrete slabs.

It is yet another object of my invention to provide a stress transfer device for also controlling the gap width at such joints thereby preventing deterioration of the joint aggregate interlock while maintaining vertical shear stress transfer across the joint.

It is still another object of my invention to provide a stress transfer device capable of transferring bending moments between adjoining slab sections of concrete pavements and the like.

It is a further object of my invention to provide a dowel-type stress transfer device having means for bonding to concrete over its end portions and means for preventing bonding over its central portion.

Yet a further object of my invention is to provide a dowel-type device that can be fabricated at low cost.

Still a further object of my invention is to provide a dowel-type stress transfer device that can greatly reduce the maintenance costs of highway pavement joints.

Another object of my invention is to provide a dowel-type stress transfer device that can be installed during paving operations with manual or automatic processes, and that requires no special installation procedures.

These and other objects and advantages of my invention will become apparent by reference to the drawings and the detailed description herein below.

DETAILED DESCRIPTION OF THE PREFERRED EMBODIMENT

Figure 1:
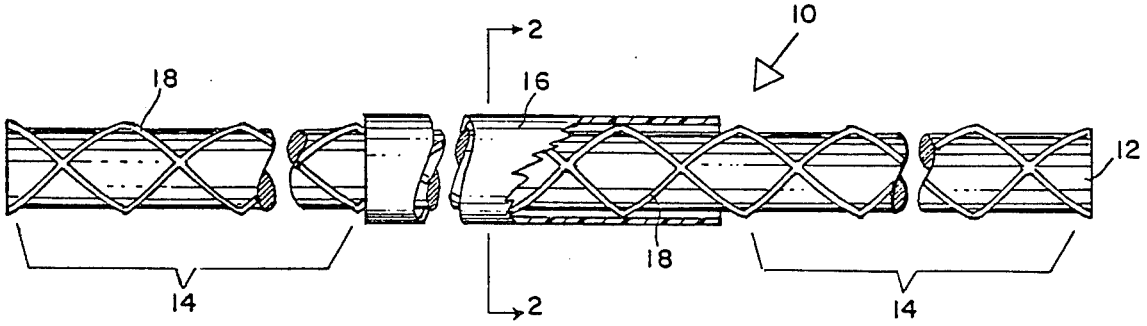
FIG. 1 is a plan view of my stress transfer device having its centrally disposed sleeve partially cut away.

The preferred embodiment of my elastic stress transfer dowel is shown in FIG. 1 and indicated generally at 10. The dowel 10 comprises a bar 12 and a sleeve 16, with sleeve 16 centrally disposed over bar 12. Bar 12 is preferably a straight length of deformed steel reinforcing bar as commonly used for reinforcing poured concrete. The steel may have an AASHTO designation of M 31-74. However, steel of various yield strengths may be used as long as the design is such as to cause the bar to operate within its elastic limit as will be explained hereinafter. Bar 12 has typical deformation ridges 18 along its surface for forming a secure bond with concrete when disposed therein.

Figure 2:
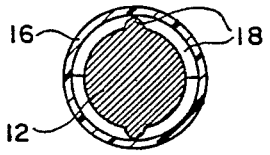
FIG. 2 is a cross section through the central portion of the device of FIG. 1.

Sleeve 16, shown partially cut away in FIG. 1, is preferably formed from a stable plastic material such as polyethylene. Sleeve 16 is sized to fit snugly over ridges 18 such that relative motion between bar 12 and sleeve 16 can occur. FIG. 2 reveals a cross section through area 2—2 in FIG. 1 and the manner in which sleeve 16 clears ridges 18.

Figure 3:
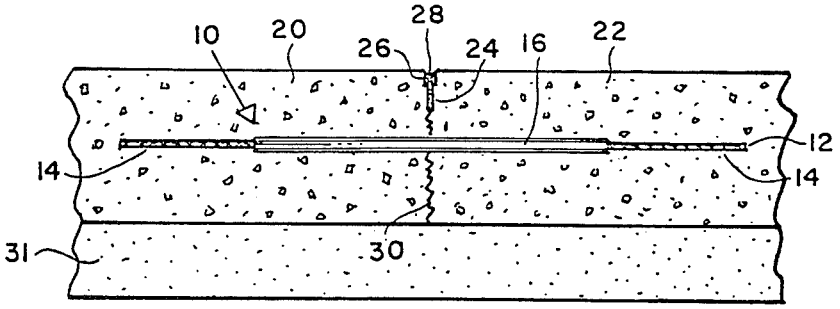
FIG. 3 is a cross-sectional view of a concrete slab joint showing the dowel device of FIG. 1 embedded therein.

My dowel 10 is to be embedded in the concrete slabs of a highway, airport runway, parking lot, and the like, and disposed so as to be centrally located with respect to a joint. FIG. 3 illustrates a typical slab joint in cross section having my dowel 10 located across the joint in a longitudinal direction. Dowel 10 is suitably maintained in the desired position over subgrade 32 during the pouring of concrete to form slab sections 20 and 22, and may approximately centered with respect to the slab thickness. The final joint comprises a groove 24 and crack 30 as will be explained more fully below. Dowel 10 spans crack 30 between slab section 20 and slab section 22. The uncovered ends 14 of bar 12 bond securely to the concrete in their respective slab sections 20, 22 while sleeve 16 prevents the central portion of bar 12 from bonding to the concrete. As may now be recognized, any relative movement between slab sections 20 and 22 will cause the central portion of bar 12 protected from bonding by sleeve 16 to slightly stretch or contract as end portions 14 move with the respective slab sections.

Figure 5:
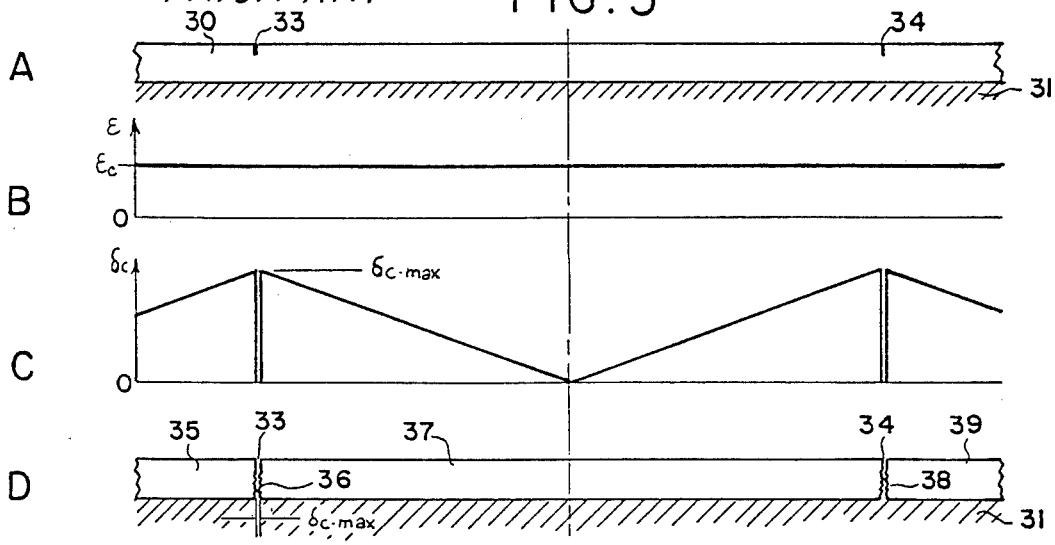
PRIOR ART FIG. 5
FIG. 5 is a stress-displacement diagram for typical prior art slab sections.

Before discussing typical dowel dimensions and calculations thereof, it is appropriate to examine typical pavement slab design and construction to show the problems that my novel elastic stress transfer dowel solves. Referring to FIG. 5, concrete pavement is generally poured as a continuous slab over a supporting subgrade 32. The concrete has a natural tendency to contract during curing due to the dehydration. For a continuous slab, such contractions would cause uncontrolled random cracking of the slab under tension, thus producing a rough unsatisfactory pavement surface. Therefore, it is conventional to separate the slab into sections longitudinally. To this end, transverse joints are formed across the pavement lanes and are appropriately spaced to prevent such random cracking.

To form a joint, a groove 34 is cut across the slab a few hours after pouring and to a depth of about one-fourth the slab thickness. As the concrete subsequently contracts, a shrinkage strain $\epsilon_c$ occurs in the concrete essentially uniform along the slab but much higher stresses at the reduced cross section due to groove 24. For pavement designed in accordance with the prior art, FIG. 5 illustrates the continuous slab as poured on line A and the shrinkage strain $\epsilon_c$ before forming of the joint on line B. Strain $\epsilon_c$ causes cracks 36 and 38 to form just below grooves 32 and 34 due to the higher stress at these points. As the strain is relieved due to cracking, displacement of the slab sections takes place about each section center line CL as shown in the displacement diagram on line C. The only restraining force on such displacement is the friction between the bottom of the slab and the subgrade 33. As may be noted, maximum displacement $\delta_{c\text{-}max}$ occurs at the point of cracking as shown in exaggerated form at 36 and 38 on line D which illustrates the slab 30 after cracking forming sections 35, 36, and 39.

The width of cracks 36 and 38 due to shrinkage is a function of slab section length, concrete mix design, and aggregate type, and typically may be on the order of 300 to 800 $\mu$in/in. Thus, the crack width may be made sufficiently small to ensure good aggregate interlock for transferring vertical shear stress across the joint. However, after curing and initial shrinkage, the concrete changes length continually due to factors such as ambient temperature changes, creep, and plastic flow. Most serious to the designer is the temporary length changes proportional to temperature variations which may be on the order of 2 to 8 $\mu$in/in/°F. Thus, under severe temperature changes, the crack width can become excessive with resultant aggregate interlock failure. Breaking and wearing of the rough interface due to live loads on the roadway can ultimately cause complete failure and vertical misalignment of the slab sections.

In an attempt to prevent or reduce such failure, prior art unbonded dowels across the joints have been utilized. While unbonded dowels may be somewhat effective in vertical shear stress transfer across the joint and in maintaining vertical slab section alignment, such devices do not lessen or control the maximum joint gap width.

Referring to FIG. 3, it may be noted that the original groove 24 cut to form the joint has been widened at the top to form wide groove 26. A mastic 28 or other type of flexible sealant is used to fill grooves 24 and 26 for preventing water and salt intrusion of the joint. As may be understood, such intrusion can damage subgrade 32, and under freezing conditions, can result in damage to the slab. When dowels are used, it is possible for the salt and water to severely corrode the steel. For the initial joint gap widths commonly used, the mastic 28 is capable of forming an adequate seal preventing intrusion. However, over extended periods of time and many cycles of uncontrolled contraction and expansion of the slabs with temperature, excessive joint gap widths occur causing failure of the mastic 28 to properly seal, resulting in subsequent intrusion problems. A majority of maintenance efforts and expense is associated with pavement joint failures of this nature.

Figure 4:
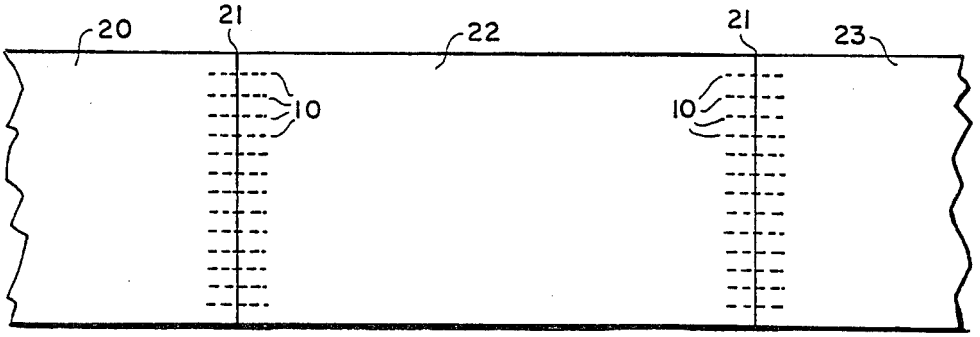
FIG. 4 is a top view of a typical highway pavement showing disposition of my dowel devices at the slab joints.

My novel elastic stress transfer dowel 10 solves the above noted problems associated with uncontrolled joint gap widths when dowels 10 are installed across the joints as in FIG. 3 and FIG. 4. As illustrated in phantom view in FIG. 4, a multiplicity of my dowels 10 is disposed across joints 21 of slab sections 20, 22, and 23. The diameter, length, spacing and numbers of dowels 10 required for a particular slab design may be calculated as shown hereinafter.

Figure 6:
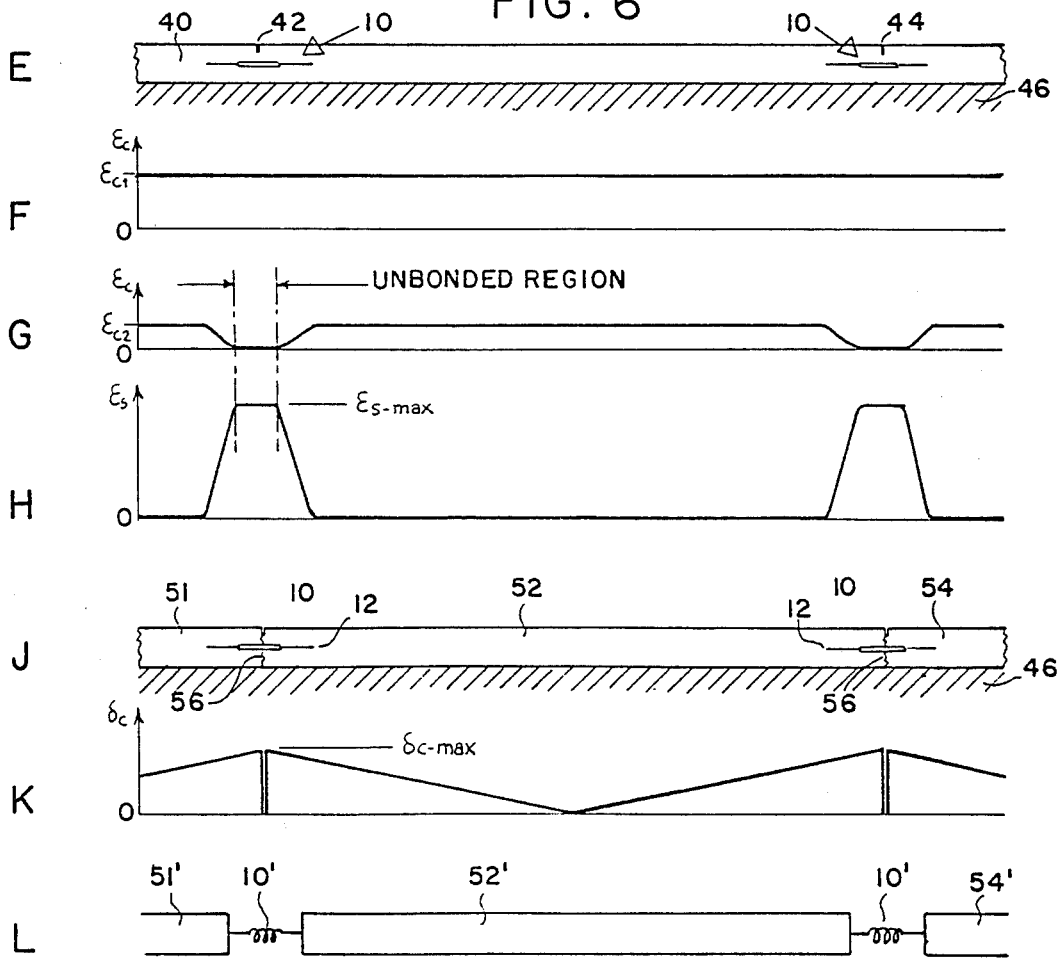
FIG. 6 is a stress-strain-displacement diagram for slab sections utilizing my elastic stress transfer dowel.

Turning now to FIG. 6, a group of diagrams is presented showing the reactions in a pavement slab constructed in accordance with my invention and revealing the advantages thereof. Line E shows a longitudinal section through a continuous slab 40 prior to forming of joints having dowels 10 installled and centered below grooves 42, 44. Line F is a strain diagram for the slab line of E showing an essentially uniform strain along the longitudinal dimension of the uncracked slab 40 causing the stress to be high at the reduced cross sections beneath grooves 42, 44. Due to the ends of dowels 10 being securely anchored and bonded to opposite slab sections, for example 51 and 51 of line J, the strain $\epsilon_{c1}$ is not relieved when cracks 56 occur during curing and shrinkage of slab 40, but is partially transferred to the bar 12 with the strain distributed along bar 12 as shown by the diagram of line H. The strain $\epsilon_s$ increases linearly from the bonded end inward to a maximum at the unbonded portion of bar 12 and is uniform over the unbonded portion. Thus, the strain in the slab section 52, for example, as shown on line G is reduced to a maximum value of $\epsilon_{c2}$ for a maximum strain in the steel bar 12 of $\epsilon_{s\text{-}max}$ shown on line H.

The displacement $\delta$ of the slab sections is illustrated by the displacement diagram of line K. Due to the restraining force of dowel 10 the displacement, and consequently the joint gap width, is significantly less than in prior art slab design in accordance with my invention. As may now be recognized, my dowel 10 acts as a latent spring as shown in the model of the slab of line L. Neglecting friction between slab 40 and subgrade 46, the slab 40 may be considered as a series of bodies 51',52', and 54' which may vary slightly in length with temperature changes, coupled together by springs 10'. Any change in strain $\epsilon_{c2}$ due to contraction or expansion of the bodies 51', 52', 54' with temperature causes an increase or decrease in strain $\epsilon_s$ in springs 10' thus reducing the displacement of the ends of bodies 51', 52' 54' as compared to a prior art design as in FIG. 5. Advantageously, the width of cracks 56 is controlled over an acceptable range by selection of the proper spring constant of bar 12, which is of course operated well within the elastic limit of the steel. The integrity of the joint and joint sealant is maintained over very long periods of time by virtue of this control. As will be obvious to those skilled in the art, dowels 10 also transfer vertical shear stresses from the pavement loads from one slab section to the next to prevent vertical displacement between adjacent slab sections.

Dimensions of my novel dowel are determined by the specific pavement design requirements as called for from live load values, concrete characteristics, environmental conditions, joint spacings, and related considerations. In general, I have found that the unbonded length of the dowel should be in the range of 0.1 to 0.25 times the length of the joint spacing. The size of bar 12 may range from a No. 3 to a No. 7 reinforcing bar size. The unbonded area of bar 12 may be provided by treating that portion of the bar with any convenient material that will not adhere to the concrete or conform to the bar deformation. A relatively stiff wrapping or covering plastic having a thickness of about 0.025" has been found effective. Material such as polyethylene or polypropylene is eminently satisfactory. In some cases, a smooth steel rod may be used to form bar 12. The outer ends of the bar are then deformed for bonding to the concrete. The central smooth area may be coated with asphalt, neoprene, rubber composition, or the like to prevent a bond between the concrete and such central area. As may be seen, it is only necessary that the unbonded section of bar 12 be able slightly contract and expand independently of the surrounding concrete, thereby providing the desired latent spring function.

The bar 12 may also have its outer ends bent to form hooks, angles, or the like to permit a strong bond in the concrete. Other methods of creating a bond only at the outer ends of the dowels 10 will be obvious to those of ordinary skill in the art, such as wiring or welding the bar 12 to transverse reinforcing bars, mesh or the like. Such variations in design are considered within the scope of my invention.

At this point, a typical numerical design calculation will be presented to illustrate an application of my invention and to more clearly demonstrate the advantageous functioning of the device. For this example, assume the following pavement specifications:

Lane width, W: 12'
Joint spacing, L: 15'
Slab thickness, T: 8"
Max. joint gap, $L_j$: 0.05"

The following parameters are to be determined:

Unbonded dowel length, $L_u$
Bonded dowel length, $L_b$
Dowel bar size
Number of dowels per lane
Dowel shear capacity, $V_d$
Lane shear capacity, $V_1$ The following characteristics of the materials is assumed:

Modulus of elasticity of steel, $E_{st}$: $30\times10^6$
Sheer capacity of steel, $V_2$: 12 ksi
Modulus of elasticity of concrete, $E_c$: $4\times10^6$
Critical strain in concrete, $\epsilon_{ct,c}$: 200 in/in
Ratio of steel area to concrete area, p: 0.006

A method of successive approximations may be used to determine the following parameters due to the initial shrinkage of the concrete slab:

Unbonded dowel steel strain, $\epsilon_{st}$
Unbonded dowel steel stress, $\sigma_{st}$
Concrete tensile stress, $\sigma_{ct}$
Concrete tensile strain, $\epsilon_{ct}$ For a first trial, an unbonded dowel length $L_u$ of 36" will be selected. The length $L_u$ may be stretched a maximum of 0.05" (the allowable joint gap, $L_j$). Calculating the strain in the steel $$\epsilon_{st}=L_j/L_u=0.05/36=1389\ \mu\text{in/in} \quad (1)$$

The steel tensile stress is thus $$\alpha_{st} = \epsilon_{st} E_{st} = 1389\times10^{-6}\times30\times10^6 = 41{,}667\ \text{psi} \quad (2)$$

The concrete tensile strength resulting from this stress in the unbonded steel is determined from the area ratio p as $$\sigma_{ct}=p\sigma_{st}=0.006\times41{,}667=250\ \text{psi} \quad (3)$$

The concrete tensile strain from this stress is $$\epsilon_{ct}=\sigma_{ct}/E_c=250/4\times10^6=62.5\ \mu\text{in/in} \quad (4)$$

This strain stretches the slab, reducing the joint width $L_j$ by $$L_j = \epsilon_{ct}(L - L_u) = 62.5\times10^{-6}(180-36) = 0.009\ \text{in} \quad (5)$$

The joint opening is thus reduced to $$L_j'=0.050-0.009=0.041\ \text{in} \quad (6)$$

The computations in (1),(2), (3), (4), and (5) may now be repeated for the joint opening found in (6) a sufficient number of iterations to obtain a close approximation to a consistent joint opening. After three such successive approximations, it will be found that $L_j$ converges to 0.0424 in. for an accuracy of better than 0.25%. The stress and strain parameters from the final approximation are found to be $$\epsilon_{st}=1175\ \mu\text{in/in} \quad (1)$$

$$\sigma_{st}=35{,}250\ \text{psi} \quad (2)$$

$$\sigma_{ct}=212\ \text{psi} \quad (3)$$

$$\epsilon_{ct}=52.9\ \mu\text{in/in} \quad (4)$$

For a slab thickness T of 8 in., the steel area per foot width of pavement is determined as $$A_s=pA_c=0.006\times8\times12=0.516\ \text{sq in} \quad (7)$$

Next, a trial bar size is selected and the resulting performance calculated. Try a No. 5 bar having an area of 0.31 sq in. The spacing for this size bar is then $$(0.31\times12)/0.576=6.46\ \text{in.; try } 6\tfrac{1}{4}\ \text{in.} \quad (8)$$

The number of dowels per 12' lane is then $$144/6.25=23\ \text{dowels} \quad (8)$$

Next, the bonded dowel length $L_b$ will be determined. The force in the steel $F_{st}$ is $$F_{st}=A_s\sigma_{st}=0.31\times35.250=10{,}930\ \text{psi} \quad (9)$$

$$\epsilon_{st}=1175\ \mu\text{in/in and } \epsilon_{ct}=52.9\ \mu\text{in/in} \quad (1), (4)$$

Try $L_b=10$ in

Modulus of elasticity of steel, $E_{st}$: $30\times10^6$
Sheer capacity of steel, $V_s$: 12 ksi
Modulus of elasticity of concrete, $E_c$: $4\times10^6$
Critical strain in concrete, $\epsilon_{ct,c}$: 200 in/in
Ratio of steel area to concrete area, p: 0.006

A method of successive approximations may be used to determine the following parameters due to the initial shrinkage of the concrete slab:

Unbonded dowel steel strain, $\epsilon_{st}$
Unbonded dowel steel stress, $\sigma_{st}$
Concrete tensile stress, $\sigma_{ct}$
Concrete tensile strain, $\epsilon_{ct}$ For a first trial, an unbonded dowel length $L_u$ of 36" will be selected. The length $L_u$ may be stretched a maximum of 0.05" (the allowable joint gap, $L_j$). Calculating the strain in the steel $$\epsilon_{st}=L_j/L_u=0.05/36=1389\ \mu\text{in/in} \quad (1)$$

The steel tensile stress is thus $$\alpha_{st} = \epsilon_{st} E_{st} = 1389 \times 10^{-6} \times 30 \times 10^6 = 41{,}667 \text{ psi} \quad (2)$$

The concrete tensile strength resulting from this stress in the unbonded steel is determined from the area ratio p as $$\sigma_{ct}=p\sigma_{st}=0.006\times41{,}667=250 \text{ psi} \quad (3)$$

The concrete tensile strain from this stress is $$\epsilon_{ct}=\sigma_{ct}/E_c=250/4\times10^6=62.5\ \mu\text{in/in} \quad (4)$$

This strain stretches the slab, reducing the joint width $L_j$ by $$L_j = \epsilon_{ct}(L - L_u) = 62.5 \times 10^{-6}(180 - 36) = 0.009 \text{ in} \quad (5)$$

$$\epsilon_{st}(L_b) = 52.9 \times 10 = 529\ \mu\text{in/in} \quad (10)$$

The strain to be dissipated in the steel is $$\epsilon_{st}(L_u)-\epsilon_{st}(L_b)=1175-529=646\ \mu\text{in/in} \quad (11)$$

The rate of strain per inch is $$646/10=64.6\ \mu\text{in/in/in} \quad (12)$$

Since the critical value is 200 $\mu$in/in, this value is satisfactory. The total dowel length is $2L_b+L_u=56''$. Next, the dowel shear capacity $V_d$ is $$V_d=A_sV=0.31\times12=3.72 \text{ k per dowel} \quad (13)$$

The lane shear capacity is then $$V_1=3.72\times23=85.6 \text{ k} \quad (14)$$

Since the maximum load from a dual tandem axle in most states is 40 kips, the value of 85.6 kips provides an adequate safety factor.

As may be understood from this example, many combinations of dowel area, bonded and unbonded lengths, and dowel spacings are available to the designer. If a larger area dowel had been chosen, the spacing would be greater since fewer dowels whould be required. However, the bond area between the steel and concrete would be reduced, increasing the bond stress. Thus, I have found that it is preferable to use small dowels with close spacing to more evenly distribute the concrete stress in the bonding regions to prevent possible cracking. Dowel spacings are preferably less than 12 inches and more than 4 inches. Bar sizes in the range of No. 3 ($\frac{3}{8}$" diameter) to No. 7 ($\frac{7}{8}$" diameter) have been found most useful.

While I have described hereinabove a basic application of my novel elastic stress transfer dowel, an even more advantageous result occurs from utilizing the dowels in pairs positioned in the slab so as to provide a resistance moment to counteract bending moments. As is well known, live loads applied to a pavement surface causes reactive stresses in the subgrade, with bending moments generated in the slab whose values depend on the strength of the subgrade. By reference to "influence charts" such as developed by Pickett and Ray, such bending moments can be calculated for various boundary conditions. The number of dowels and the proper placement thereof can be calculated to provide both the desired resistance moment and gap control tension simultaneously.

Figure 7:
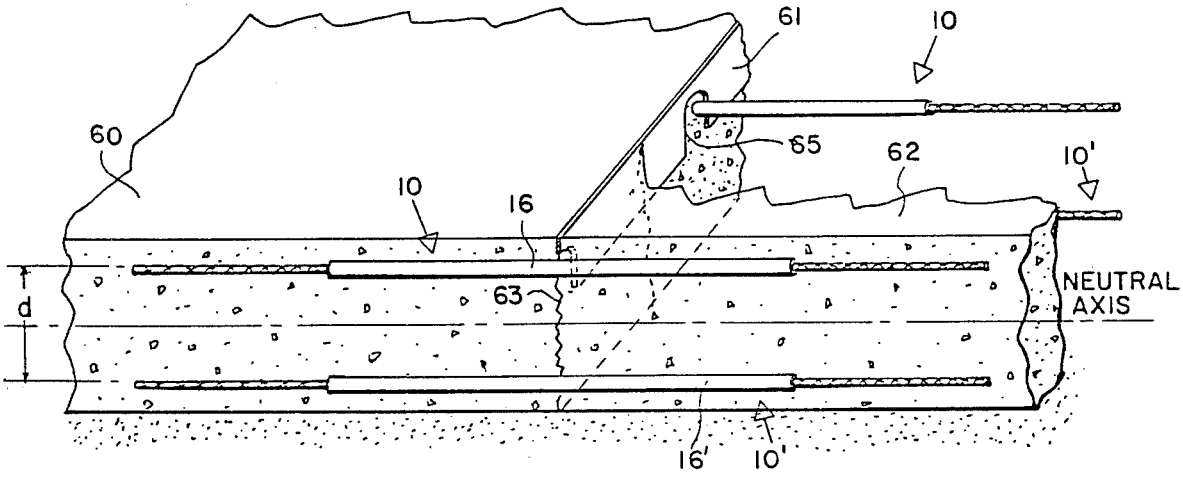
FIG. 7 is a cross-sectional view of a concrete slab joint showing my elastic stress transfer dowel embedded therein so as to produce moments resistant to bending moments due to live loads.

To create full structural continuity between adjoining slab sections, my dowels are capable of transferring bending moments by installing across the slab joint as illustrated in a joint cross-sectional view of FIG. 7. As is well known, the stress due to bending moments will be zero along the neutral axis and increase linearly toward the top and bottom surfaces of the slab. Thus, one dowel 10 is installed near the top surface and a second dowel 10' near the bottom surface. The dowels are otherwise designed to transfer the vertical sheer stress across joint gap 63 and to provide elastic tension between slab sections 60 and 62 as set forth at length above. Thus, dowels 10 and 10' are in regions of high stress due to the bending moment from surface point loads.

Figure 8:
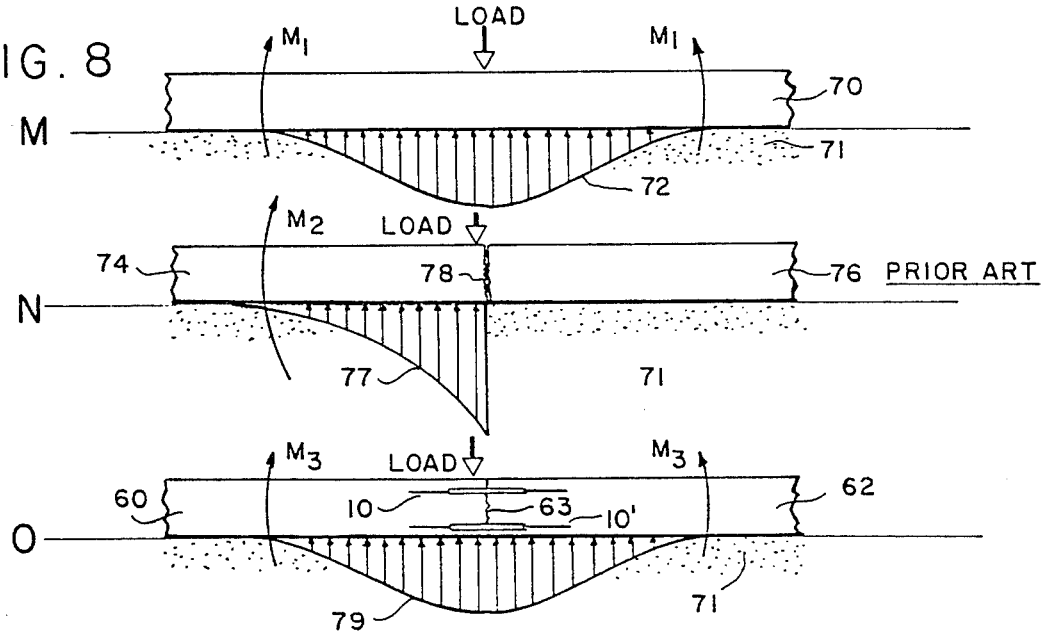
FIG. 8 is a diagram showing moments and subgrade stresses produced in concrete slabs and substrates with and without my elastic stress transfer dowel.
Figure 9:
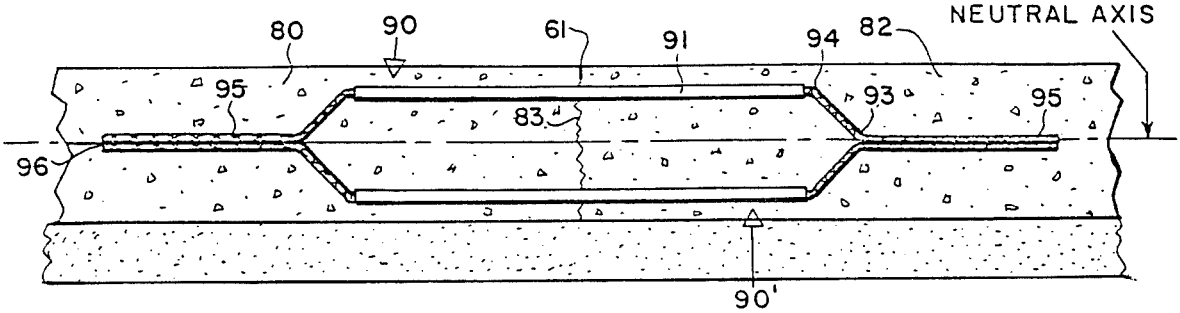
FIG. 9 is a cross-sectional view of a concrete slab joint showing an alternative embodiment of my elastic stress transfer dowel especially adapted for moment transfer, with the dowel embedded therein.

FIG. 8 illustrates graphically the effects of point loads on a typical pavement slab without and with the use of my dowels to resist the bending moments. On line M, a central portion of a slab section is shown supported by subgrade 71. A live load causes a force at the center of slab section 70 which is resisted by subgrade 71 creating the stress shown as curve 72. This action creates equal moments $M_1$ to the right and left of the load point. Since the slab 70 is continuous along the area of stress, proper design thereof will allow the pavement to withstand the applied live load without damage.

Line N represents prior art slab sections 74 and 76 having a joint 78 therebetween with a live load applied at a point just to the left of the joint. The force of the load causes the stress shown by curve 77 which has a maximum at the joint. The force is resisted by the substrate 71 and moment $M_2$ to the left of the joint occurs. The high stress at the joint will result in compression of the substrate and downward movement of slab section 74 opening gap 78 slightly at the bottom and closing at the top. Such movement tends to damage the aggregate interlock with ultimate failure of the joint. As the live load crosses the joint, the same movement occurs with slab section 76 causing additional "working" of the joint 78.

Line O illustrates a joint as in line N but with my dowels 10 and 10' installed as in FIG. 7. The moment $M_2$ of line N is now transferred partially to section 62 resulting in smaller and approximately equal and opposite moments $M_3$. The stress curve 79 is smaller than curve 77, and less pressure is placed on substrate 71. Advantageously, the joint area now responds identically to a straight, unjointed area as in line M. Thus, this application of my invention virtually eliminates the working of joint 63 and can therefore preclude failures from such cause.

For this particular application of my invention, I have found that an alternative embodiment is particularly advantageous. FIG. 8 shows this version of my elastic dowel installed at a pavement joint shown in cross section. As mentioned above, there is no stress due to bending moments in the slab along its neutral axis, and it is therefor advantageous to dispose the anchoring or bonding region of the dowel along this axis so that the stress in the bonded part of the steel is minimized. To this end, each dowel has its unbonded sleeve 91 positioned in areas of high moment stress near the top and bottom surfaces of slab sections 80 and 82., with the bonded ends bent so as to place the bonding area of the steel along the neutral axis. For example, bar 92 may be bent at 45° at point 94 then at 45° at point 93 so as to bring end 95 parallel with the central portion having sleeve 91. The resulting shape thus allows the unbonded region to lie in a high moment stress area and the bonding region in a low moment stress area. The two dowels shown generally as 90 and 90' may be tied together or welded at ends 95 to form a single unit for convenience in installation.

The resistance moment of my dowels in this application is calculated from the cross-sectional area of the bar, the moment arm determined from the distance between the upper and lower portions of the dowels and the neutral axis. The stress in the unbonded steel is $M_r = A_s \sigma_s d$ where d = neutral axis to unbonded portion distance. For the slab design of the preferred embodiment description, the moment capacity may be illustrated. Assume that the vertical spacing of the paired dowels is $5\frac{1}{2}$ inches and 12 pairs are spaced laterally by $12\frac{1}{2}$ inches. From equation (3), $\sigma_{st} = 35{,}250$ psi and $A_s$ is 0.31 sq in; the resistance moment is $$M_r = 0.31 \times 35{,}250 \times 5.5 = 60.1 \text{ in-kips}$$

$$M_{lane} = 60.1 \times 12 = 721 \text{ in-kips} \quad (15)$$

For a typical subgrade strength, pavement physical parameters and highway loadings, the bending moments due to live loads may have a maximum of 3 in-kips per inch of slab width. The capacity per inch width of the above design is 60.1/12.5 = 4.8 in/kips/in. Thus, the design has a safety factor of 4.8/3 = 1.6.

My novel elastic stress transfer dowel described above provides a simple, effective, low cost device that can significantly reduce both the initial construction costs and subsequent joint maintenance costs of concrete pavements and the like. In addition, the device makes possible a new process or method for constructing concrete pavements having controlled joint gap widths. Such new method includes the steps of: disposing a set of elastic shear stress transfer dowels in a continuously poured concrete slab, with a multiplicity of such dowels longitudinally aligned with the roadway, and spaced in parallel relationship across the roadway; bonding the ends of the dowels in the poured concrete; preventing the bonding of the central portions of the dowels to the poured concrete; forming a groove transversely across the slab before curing of the concrete and immediately above the unbonded central portions of the dowels; and curing the concrete to cause shrinkage thereof thereby causing a joint crack to form completely through the slab thickness along the line of the groove and whereby such shrinkage places the unbonded portions of the dowels under tension.

Having described my novel elastic stress transfer dowel showing certain specific modes of implementation, variations and substitutions of materials and changes in construction will be apparent to those of skill in the art and such changes are considered to fall within the scope and spirit of my invention.

I claim:

1. A device for simultaneously controlling the width of a joint between concrete pavement slab sections, transferring vertical shear stresses across said joint, and transferring bending moments across said joint, comprising:

a pair of elastic bars, each of said bars having two end portions and a central portion and having a length short relative to the length of the slab sections, said pair of bars disposed symmetrically and longitudinally across said joint wherein one bar of said pair is disposed with its central portion near the top surface of the slab sections, and the other one of said pair is disposed with its central portion near the bottom surface of the slab sections, and arranged to transfer vertical loads and bending moments caused by a traffic load of a desired maximum value applied to one slab section across said joint to the adjacent slab section, said pair of bars selected to withstand such vertical loads and bending moments without deformation, each of said pair of elastic bars formed to dispose said end portions of said bars essentially along the neutral axis of the concrete slab sections; and means for partially transferring longitudinal stress comprising bonding means associated with said end portions of said bars for bonding said end portions to the concrete slab sections along the neutral axis, and bonding prevention means associated with said central portion of said bars for allowing movement of said central portion with respect to the concrete slab sections, said stress transferring means partially transferring longitudinal stress in the concrete slab sections due to contraction and expansion of said pair of elastic bars, said elastic bars also selected to operate within their elastic limit over a desired stress range in such concrete slab sections to limit the joint gap width to a selected value.

2. A non-reinforced jointed concrete pavement slab having a controlled transverse contraction joint gap width comprising:

a multiplicity of independent elastic load transfer dowels formed from lengths of concrete-reinforcing bars short relative to the length of a section of said concrete slab, said dowels embedded longitudinally in said slab and arranged to symmetrically span the joint, said dowels disposed in an essentially parallel relationship over the extent of the joint, with the number and cross-sectional areas of said dowels selected to transfer vertical traffice loads of a desired maximum value across the joint without deformation on said dowels, said dowels arranged in pairs with one of each of said pair having its center section disposed near the top surface of said slab, and the other one of said pair having its center section disposed near the bottom surface of said slab; and means for partially transferring longitudinal stresses in the sections of said concrete slab to said elastic dowels comprising deformation of the ends of each of said bars causing said ends to bond to the concrete to said slab, and a plastic covering of the center sections of each of said bars for preventing said center sections from bonding to the concrete thereby allowing said center sections to move relative to the surrounding concrete, with the number and cross sectional areas of said dowels also selected to operate in tension within their elastic limits over a desired stress range sufficient to maintain a selected joint gap width, in which said ends of each of said pair of dowels formed to lie and bond along the neutral axis of said slab, with the numbers and cross-sectional areas of said dowels also selected to additionally transfer bending moments caused by desired maximum traffic loads applied to one of said slab sections across the joint to the adjacent one of said slab sections without deformation of said dowels.

* * * * *